United States Patent [19]

Arai et al.

[11] Patent Number: 4,550,245

[45] Date of Patent: Oct. 29, 1985

[54] LIGHT-RADIANT FURNACE FOR HEATING SEMICONDUCTOR WAFERS

[75] Inventors: Tetsuji Arai, Kobe; Hiroshi Shimizu, Yokohama, both of Japan

[73] Assignee: Ushio Denki Kabushiki Kaisha, Tokyo, Japan

[21] Appl. No.: 480,073

[22] Filed: Mar. 29, 1983

[30] Foreign Application Priority Data

Oct. 26, 1982 [JP] Japan ..... 57-186846

[51] Int. Cl.[4] ..... H05B 1/00; F27D 11/02

[52] U.S. Cl. ..... 219/405; 219/411; 219/343; 118/724

[58] Field of Search ..... 219/411, 405, 354, 343, 219/347; 432/147, 148, 194; 118/724, 50.1

[56] References Cited

U.S. PATENT DOCUMENTS

| | | | |
|---|---|---|---|
| 3,188,459 | 6/1965 | Bridwell | 219/343 |
| 3,240,915 | 3/1966 | Carter | 219/343 |
| 3,242,314 | 3/1966 | Eckles | 219/343 |
| 3,304,406 | 2/1967 | King | 219/411 |
| 3,836,751 | 9/1974 | Anderson | 219/405 |
| 4,101,759 | 7/1978 | Anthony | 219/411 |
| 4,167,915 | 9/1979 | Toole | 118/724 |

*Primary Examiner*—Roy N. Envall, Jr.
*Assistant Examiner*—Teresa J. Walberg
*Attorney, Agent, or Firm*—Ziems, Walter & Shannon

[57] ABSTRACT

A light-radiant heating furnace including a box-shaped container, having a transparent wall portion, adapted to receive an object to be treated, for example, a large-sized semiconductor wafer, a reflector arranged in the proximity of outer surfaces of the transparent wall portion of the container, a space formed between the reflector and the outer surface of the transparent wall portion of the container, tubular lamps provided in the space and an air duct equipped with a cooling fan and arranged in communication with the spacing only. The lamps and their adjacent reflector and container wall can be efficiently cooled by causing cooling air to pass through the air duct and space, thereby avoiding overheating of the lamps and thus prolonging the service lives of the lamps. The reflector may be provided with water conduits through which cooling water flows.

6 Claims, 4 Drawing Figures

LIGHT-RADIANT FURNACE FOR HEATING SEMICONDUCTOR WAFERS

BACKGROUND OF THE INVENTION (1.) Field of the Invention

This invention relates to a light-radiant heating furnace, and more specifically to a light-radiant heating furnace equipped with an air-cooling system for its lamps so as to avoid overheating of the lamps.

(2.) Description of the Prior Art

Among a variety of apparatus adapted to carry out heat treatments therein, light-radiant heating furnaces in which light radiated from an incandescent lamp or lamps is irradiated onto objects or materials to be treated (hereinafter referred to merely as "objects") for their heat treatment have the following merits:

(1) Owing to an extremely small heat capacity of an incandescent lamp per se, it is possible to raise or lower the heating temperature promptly;

(2) The heating temperature can be readily controlled by controlling the electric power to be fed to the incandescent lamp;

(3) Since they feature indirect heating by virtue of light radiated from their incandescent lamps which are not brought in contact with the objects, there is little danger of contaminating objects under heat treatment;

(4) They enjoy less energy consumption because full-radiation-state operation of the lamps is feasible a short time after turning the lamps on and the energy efficiencies of the lamps are high; and (5) They are relatively small in size and inexpensive compared with conventional resistive furnaces and high-frequency heating furnaces.

Such light-radiant heating furnaces have been used for the heat treatment and drying of steel materials and the like and the molding of plastics as well as in thermal characteristics testing apparatus and the like. Use of light-radiant heating furnaces have, particularly recently, been contemplated to replace the conventionally-employed resistive furnaces and high-frequency heating furnaces for carrying out certain semiconductor fabrication processes which require heating, for example, diffusion processes of dopant atoms, chemical vapor deposition processes, annealing processes for healing crystal defects in ion-implanted layers, thermal treatment processes for activation, and thermal processes for nitrifying or oxidizing the surfaces of silicon wafers. As reasons for the above move, may be mentioned the incapability of conventional heating furnaces for use of heating larger-sized objects uniformly, thereby failing to meet the recent trend toward larger semiconductor wafer size in addition to such advantages of light-radiant heating furnaces that objects under heat treatment are free from contamination, their electric properties are not deleteriously affected and the light-radiant heating furnaces require less power consumption.

Light-radiant heating furnaces have various merits as mentioned above and have found wide-spread commercial utility in the industry. However, conventional light-radiant heating furnaces are accompanied by such shortcomings that they are unable to heat objects of large sizes uniformly to high temperatures at high heating speeds. Namely, each lamp is equipped with a sealed envelope made of silica glass or the like and forms a point or line light source. It thus cannot make up by itself a plane light source which extends two-dimensionally. Therefore, it may be able to heat a very small area to high temperatures but is unable to heat a large area to high temperatures. For the reasons mentioned above, a plurality of lamps are arranged in a conventional light-radiant heating furnace. However, it is necessary, from the practical viewpoint, to avoid any highly-concentrated arrangement of a number of high power lamps since, when lamps are disposed close to one another, their envelopes become hotter and their service lives become extremely short as their outputs increase. As a result, the object is heated unevenly due to non-uniform irradiation intensity and the object may develop a certain deformation, when the object has a large size. Furthermore, such a conventional light-radiant heating furnace cannot increase the intensity of irradiating energy in its irradiation space. Thus, the possible upper limit of the heating temperature is as low as about 1200° C., leading to such drawbacks that it is unable to effect an intended heat treatment to any satisfactory extent or otherwise it requires a longer treatment time period to achieve a necessary heat treatment.

The above-mentioned drawbacks will become serious problems where precisely-controlled heating is required, particularly, in the heating step of semiconductor fabrication for instance.

SUMMARY OF THE INVENTION

The present invention has been completed with the foregoing in view and has as its object the provision of a light-radiant heating furnace in which a plurality of tubular lamps are arranged at a high concentration, these lamps and their corresponding reflector and container wall—which reflector and wall are located in the proximity of the lamps—can be cooled efficiently, and an object of a large size can be heated with a high degree of uniformity by radiant energy of a high intensity.

The present invention thus provides a light-radiant heating furnace comprising:

a box-shaped container having a transparent wall portion made of a high melting-point material, defining a gas intake port and gas exhaust port, and adapted to have positioned therein an object to be treated;

a reflector arranged in the proximity of the outer surface of the transparent wall portion of said container;

tubular lamps provided in a space between said reflector and said transparent wall portion of said container; and an air duct equipped with a cooling fan and arranged in communication with said space only.

The above-described object of this invention has accordingly been achieved by the above-defined light-radiant heating furnace, namely, by making it possible to cool lamps, which are the heat source of the heating furnace, and their adjacent reflector with a high degree of efficiency.

The above and other objects, features and advantages of the present invention will become apparent from the following description and the appended claims, taken in conjunction with the accompanying drawings.

DETAILED DESCRIPTION OF THE INVENTION AND PREFERRED EMBODIMENT

Figure 1:
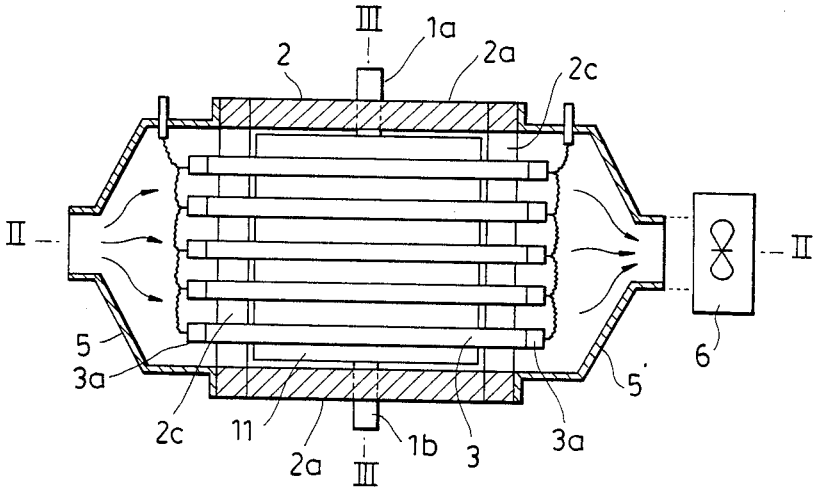
FIG. 1 is a cross-sectional view of a light-radiant heating furnace according to one embodiment of this taken along a plane parallel to the ground.
Figure 2:
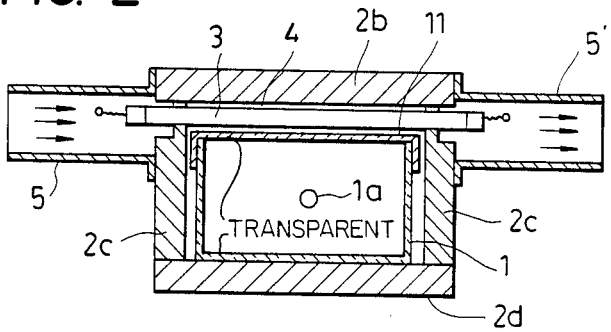
FIG. 2 a vertical cross-sectional view of the light-radiant heating furnace, taken along line II—II of FIG. 1.
Figure 3:
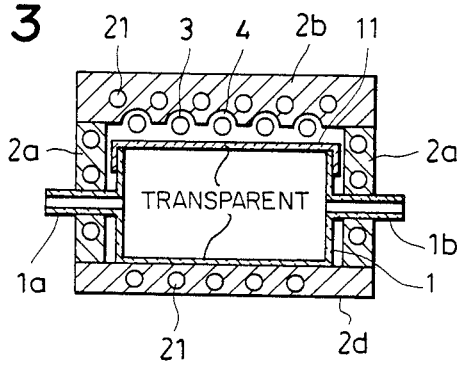
FIG. 3 is a vertical cross-sectional view of the light-radiant furnace, taken along line III—III of 1.
Figure 4:
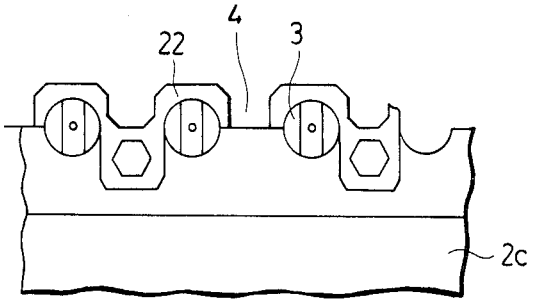
FIG. 4 is an enlarged schematic fragmentary view of the light-radiant heating furnace of FIG. 1, illustrating the way of supporting the lamps.

As depicted in FIGS. 1 through 3, a container 1 in which an object is to be placed is a transparent box made of a high melting-point material, for example, silica glass and forms a closed space in cooperation with a lid 11. Through both side walls of the container 1 are respectively formed a gas intake port 1*a* and gas exhaust port 1*b*, whereby evacuation of the interior of the container 1 or control of the interior atmosphere of the container 1 is permitted. Reflectors 2 are arranged all over the outer surfaces of the container 1 and in the proximity of the outer surfaces of the container 1 in such a way that they are disposed in a box-like shape and surround substantially the container 1. The reflectors 2 bear mirrors on their inner surfaces and define water conduits 21 through the interiors thereof. Among the reflectors 2, a side reflector 2*a* is openable so that the container 1 may be drawn out of the furnace. A plurality of grooves, each of a semi-circular configuration, are formed in the inner surface of the upper reflector 2*b*, thereby to form a space 4 between the grooves and the top wall of the container 1. Needless to say, a plurality of ridges may be spacedly provided on the inner surface of the upper reflector 2*b* in place of such grooves. Lamps 3 are, as shown in FIG. 4, supported on the top edges of the end reflectors 2*c*,2*c* by means of their respective holders 22. These holding parts of the lamps 3 are in communication with the space 4. Incidentally, the holding of the lamps 3 is individually effected immediately inside both of the pinch-sealed end portions 3*a*,3*a* by means of their corresponding holders 22. Therefore, conduction of heat, which is to be generated with the radiation of light, will be prevented by the water-cooled reflectors 2 and holders 22. Accordingly, the pinch-sealed end portions 3*a*,3*a* are protected from overheating and deterioration. Outside the holding parts of the lamps 3, air ducts 5,5′ are provided in communication with the holding parts. The air duct 5′ is connected to a cooling fan 6 so as to exhaust the interior air. Thus, air, which has been caused to flow in through the air duct 5 from the exterior, is allowed to flow substantially through the space 4 only and is then exhausted.

Operation of the above heating furnace will next be described with reference to certain specific figures which will be given merely for the purpose of illustration.

The tubular halogen lamps 3 having an outer diameter of 10 mm and a rated power consumption of 230 V–3200 W were arranged in parallel with an interval of 20 mm between the longitudinal axes of each two adjacent lamps. The clearance between the circumference of each lamp 3 and its corresponding outer surface of the container 1 of 230 mm×230 mm×80 mm and the clearance between the circumference of each lamp 3 and the wall of its respective groove of the upper reflector 2*b* were each set at 6 mm. The cooling fan 6 was able to produce a maximum air flow rate of 8 $m^3$/min. When the lamps 3 were turned on, light was irradiated to the container 1 including the light reflected by the reflector 2, and an object positioned inside the container 1 was subjected to its heat treatment. Each of the lamps 3 was fed with an electric power of 1600 W, which was one half of its rated power consumption, thereby heating a silicon wafer of 450 μm in thickness and 4 inches square in area. Here, the temperature change of the wafer was measured by means of a thermocouple bonded thereto. The temperature of the wafer rose to 1200° C. upon an elapsed time of 10 seconds after turning the lamps 3 on and, when the rated electric power of 3200 W was applied, the temperature of the wafer reached 1200° C. upon an elapsed time of 3 seconds after turning the lamps 3 on. In each of the above cases, all surface layers of the silicon wafer were eventually caused to melt.

In the above embodiment, the cooling air caused to flow in by the drawing force of the cooling fan 6 was allowed to flow along the space 4, whereby it forcedly cooled the lamps 3 and, at the same time, their adjacent reflector 2*b*. Since the reflectors 2 were arranged in the proximity of the outer surfaces of the container 1 and surrounded the container 1 substantially in a closed fashion, the cooling air flow was allowed to travel practically through the space 4 only, without developing turbulence, and the lamps 3 and their corresponding reflector 2*b* and outer surface of the container 1 were cooled efficiently. Thus, even if the lamps 3 are of a large output or the lamps 3 are arranged at a high concentration with a small interval between each two adjacent lamps, the service lives of the lamps 3 can be prevented from getting shorter. This permits a plurality of lamps 3 to be arranged at a high concentration. By arranging at a high concentrationa plurality of tubular lamps 3 which can individually form line light sources only, the plurality of lamps 3 altogether can practically form a plane light source for an object positioned in the container 1. It is also possible to make the distribution of illuminance uniform along the direction transverse to the parallelly-disposed lamps 3 by equalizing the spacing between each two adjacent lamps 3 or arranging the lamps 3 with a suitable interlamp spacing. Correspondingly, a large-sized object may be heated by high-density irradiation energy with a high degree of uniformity. Therefore, the light-radiant heating furnace according to this invention is useful particularly where heating a large-sized object uniformly, to a high temperature is required as in a fabrication process for semiconductors.

Since the light-radiant heating furnace of this invention includes a reflector which is confronted with a transparent wall portion of a container and permits cooling air to pass only through a space in which lamps are provided, the lamps and their adjacent reflector and container wall can be efficiently cooled. This permits a plurality of lamps to be arranged in parallel at a high concentration, whereby heating a large-sized object by high-density irradiation energy with a high degree of uniformity is enabled.

In the illustrated embodiment, each of the reflectors 2*a*,2*b*,2*c*,2*d* is provided with water conduits 21. It may however be sufficient, in some instances, to provide such water conduits only for reflectors provided in the proximity of lamps, for example, only for the top reflector 2*b* in the illustrated embodiment.

Having now fully described the invention, it will be apparent to one of ordinary skill in the art that many changes and modifications can be made thereto without departing from the spirit or scope of the invention as set forth herein.

What is claimed:

1. A light-radiant furnace for heating semiconductor wafers comprising:

a container of predetermined shape made of a transparent material of high melting-point and adapted to have positioned therein an object to be treated, said container defining a gas intake port, a gas exhaust port and a plurality of outer surfaces;

a plurality of reflectors substantially surrounding said container in the proximity of the outer surfaces of the container so that they are disposed in a shape congruent to the shape of said container;

means for defining a space having opposite ends and being closed between said opposite ends, said space defining means including one of said outer surfaces of the container and an associated one of said reflectors;

an inlet air duct in communication with said space at one of said opposite ends and an outlet air duct in communication with said space at the other of said opposite ends;

means associated with one of said air ducts for causing air to flow through said space in a predetermined direction from the inlet air duct to the outlet air duct; and tubular lamps in said space parallel to and spaced from one another and parallel to said predetermined direction of air flow.

2. The light-radiant heating furnace as claimed in claim 1, wherein said container is made of silica glass.

3. The light-radiant heating furnace as claimed in claim 1, wherein said reflectors define, water conduits connected to a cooling-water feeding system.

4. The light-radiant heating furnace as claimed in claim 1, wherein said tubular lamps are tubular halogen lamps.

5. The light-radiant heating furnace as claimed in claim 1, wherein said associated one of said reflectors defines a surface facing said one of said outer surfaces of the container and grooves in said facing surface, said grooves receiving at least portions of said tubular lamps.

6. The light-radiant heating furnace as claimed in claim 1, further comprising holders for supporting said tubular lamps, each of said tubular lamps having sealed end portions, said holder supporting said lamps immediately adjacent the sealed end portions and being cooled by the air flowing through the space.

* * * * *